US010320074B2

(12) United States Patent
Roy et al.

(10) Patent No.: US 10,320,074 B2
(45) Date of Patent: Jun. 11, 2019

(54) SATELLITE BROADCAST RECEPTION ANTENNA, METHOD AND APPARATUS FOR SEARCHING AND IDENTIFICATION OF BROADCAST SATELLITES IN GEOSTATIONARY ORBIT

(71) Applicant: Electronic Controlled Systems, Inc., Bloomington, MN (US)

(72) Inventors: Rudrava Roy, Munich (DE); Indrava Roy, Bihar (IN); Craig Miller, Eden Prairie, MN (US)

(73) Assignee: Electronic Controlled Systems, Inc., Bloomington, MN (US)

( * ) Notice: Subject to any disclaimer, the term of this patent is extended or adjusted under 35 U.S.C. 154(b) by 283 days.

(21) Appl. No.: 15/436,430

(22) Filed: Feb. 17, 2017

(65) Prior Publication Data

US 2017/0237161 A1 Aug. 17, 2017

Related U.S. Application Data

(60) Provisional application No. 62/296,597, filed on Feb. 17, 2016.

(51) Int. Cl.
*H01Q 3/08* (2006.01)
*H01Q 1/28* (2006.01)

(52) U.S. Cl.
CPC ..... *H01Q 3/08* (2013.01); *H01Q 1/288* (2013.01)

(58) Field of Classification Search
CPC ..... H01Q 3/08; H01Q 1/288
See application file for complete search history.

(56) References Cited

U.S. PATENT DOCUMENTS

| | | | |
|---|---|---|---|
| 6,864,846 | B2 | 3/2005 | King |
| 7,570,222 | B2 | 8/2009 | King |
| 8,134,512 | B1 | 3/2012 | Chen et al. |
| 8,368,611 | B2 | 2/2013 | King et al. |
| 8,789,116 | B2 | 7/2014 | Miller et al. |
| 9,225,061 | B2 | 12/2015 | Shuster et al. |
| 2013/0285864 | A1 | 10/2013 | Clymer et al. |
| 2014/0259080 | A1 | 9/2014 | King |
| 2015/0365731 | A1 | 12/2015 | Miller et al. |

OTHER PUBLICATIONS

The International Search Report and Written Opinion rendered by the International Searching Authority for PCT/US17/18471, dated May 30, 2017, 11 pages.

*Primary Examiner* — Graham P Smith
(74) *Attorney, Agent, or Firm* — Skaar Ulbrich Macari, P.A.

(57) ABSTRACT

Finding and recognizing geostationary satellite orbital slots includes acquiring a location estimate for a satellite broadcast receiving antenna. A set of satellite look angles is captured in the antenna's reference frame coordinate space. A pattern of expected look angles is generated from the antenna location estimate. A pattern matching algorithm is executed to determine azimuth axis rotation to transform antenna reference frame into world reference frame. The validity of the reference frame transform is then checked for correctness by looking for a satellite position outside the set of satellite positions used for the pattern matching.

20 Claims, 7 Drawing Sheets

SATELLITE BROADCAST RECEPTION ANTENNA, METHOD AND APPARATUS FOR SEARCHING AND IDENTIFICATION OF BROADCAST SATELLITES IN GEOSTATIONARY ORBIT

PRIORITY

This application claims the priority benefit of U.S. Provisional Application No. 62/296,597, filed on Feb. 17, 2016, which is hereby incorporated herein by reference in its entirety.

FIELD

The present invention relates generally to satellite broadcast reception antennas and, more particularly, to methods, systems and apparatus for locating and identifying broadcast satellite positions in geostationary orbit, and aiming a satellite broadcast reception antenna at a desired satellite position.

BACKGROUND

Satellite broadcast signals of various types are broadcast from satellites orbiting the Earth. Many broadcast satellites, such as television broadcast satellites, are located in geostationary orbital slots, so they are always in the same place with respect to the earth.

Finding and locking onto a given broadcast satellite signal is not an easy task since there are many sources of radio frequency energy in the sky. Indeed, for television there are two different, and incompatible, satellite television service providers in the United States. The difficulty of finding and locking onto broadcast satellites is further complicated by the fact that various broadcasters often spread portions of their available programming across many separate satellites located at physically different locations (referred to as orbital slots) in the sky.

A given broadcast satellite also has a finite broadcast bandwidth. Therefore, it is necessary for satellite broadcasters, for example DISH Network and DirecTV for satellite television broadcasts, to spread their programming across more than one satellite located at different orbital slots. Thus, for a customer to receive their full compliment of programming, their satellite antenna equipment would need to aim and lock on to broadcast satellites located two or more different orbital slots (e.g., 110 degrees and 119 degrees, etc.) depending on what channel the user has chosen via their television set top box. With the adoption of high definition (HD) programming, etc., the proliferation of distinct satellite orbital slots has become commonplace.

Satellite broadcast signals are received with an antenna. The antennas can come in many styles and variations, including portable, mobile, fixed, enclosed and non-enclosed. However, most types of conventional satellite broadcast reception antennas include a reflector dish and a signal converter (e.g. low noise block downconverter (LNB)). The incoming signals broadcast by the satellite are collected by the reflector dish and focused or concentrated into the inlet of the LNB. In order to receive adequate signal strength, such as to produce a viewable picture on the user's television, these antennas have to be pointed directly at the broadcast satellite position.

Because of the pointing requirements, the setup of a satellite reception system is relatively complex as compared to terrestrial broadcast signals. Typically, the user has to have proper training and tools, or a professional installer is necessary, to mount the antenna to a user's house, building or other sturdy structure, and then carefully aim the antenna at the target satellite positions.

The aiming process is further complicated when attempting to receive modern high definition television programming since the user most often receives broadcast signals from multiple different satellite orbital slots in order to receive the user's full compliment of programming. Thus, the elevation, azimuth and skew of the antenna must be in correct alignment for the user to receive their subscribed programming. If the antenna is disturbed or moved, then it may have to be re-aimed, typically by a technician.

Thus, it can be easily appreciated that the installation and maintenance process for satellite antennas is costly to the user and/or the service provider due to the costs of training and maintaining many technicians to service customer needs.

One solution to make satellite antenna aiming easier is to provide the antenna with electronic motors and control systems to automate antenna movements. However, the conventional automated antenna systems need a way to identify the specific orbital slot to which it is pointed. Thus, either a person has to manually actuate the aiming motors, or the fully automated system has to include electronics to decode satellite identification if such data is encoded within the broadcast data stream. By decoding the satellite identification in the data stream, the fully automated antenna can make a positive identification of each satellite orbital slot it might aim at after a searching operation. For example, this identification data is encoded in satellite television broadcasts according to the so-called Digital Video Broadcast-Satellite (DVB-S) data standard, which can be decoded by DVB-S decoding circuitry included within the satellite television antenna electronics. However, this solution necessarily adds complexity, potential for obsolescence and cost to the antenna device.

Another solution that avoids the need to include decoding circuitry, such as DVB, in the antenna electronics is to use an antenna system configured to communicate with an external control box or decoder box (e.g. a television set top box (STB) that is connected to the user's television) in order to obtain the satellite identification data from the external control box. Such a method, system and antenna are disclosed in U.S. Pat. No. 8,789,116, which is hereby incorporated herein by reference in its entirety. However, this device, system and method have the drawback of the need to have a two-way exchange of data with the STB. Thus, the antenna must be configured to follow the communication protocols dictated by the STB supplier and/or service providers for the user's particular satellite television service. Not all control devices are enabled or configured to perform this type of communication, and the communication protocols are different and incompatible for each of the different service providers and types of broadcasts. Additionally, communications protocols and/or identifications schemes are subject to change at any time, thereby necessitating a software update to the antenna, or worse, rendering the antenna unusable.

Therefore there remains a need to provide an improved satellite broadcast reception antenna, system and satellite antenna aiming method that allows the desired satellite orbital slots to be locked onto and identified without the need for decoding of satellite identification data by either onboard electronics or by electronics within an external control box.

SUMMARY

The present invention addresses certain deficiencies discussed above by providing for a device, method and system of a satellite broadcast receiving antenna that can search for, lock onto and identify whether the satellites needed for broadcast reception have been located. The disclosure will discuss certain example embodiments directed to the application of satellite television. However, the present invention can be applied to find and lock onto any type of satellites in geostationary orbit.

Generally, the method disclosed includes rotating the antenna's reference frame along the azimuth axis to match terrestrial north in a world reference frame. Then, with a roughly known location of the antenna itself, any geostationary satellite can be located without need to retrieve satellite identifications from the broadcast satellite's downlink signal stream (e.g. via DVB) or from the satellite broadcaster's set top box. Thus, the present invention is not dependent on the particular type of set top box or the user's specific service provider.

The method includes acquiring a location estimate for the antenna. A set of satellite look angles is calculated in the antenna's reference frame coordinate space. A pattern of expected look angles is generated from the antenna location estimate. A pattern matching algorithm is executed to determine azimuth axis rotation to transform antenna reference frame into world reference frame. The validity of the reference frame transform is then checked for correctness by looking for a satellite position outside the set of satellite positions used for the pattern matching.

The method can be formed as an algorithm, stored as code in memory, resident in a satellite broadcast reception antenna apparatus and executed by a microprocessor of the antenna device.

The algorithm can be used to point at one or at multiple satellite orbital slots simultaneously.

Skew can be adjusted by calculating the desired skew angle based upon the antenna's calculated location data and using conventional skew calculation formulas included in the algorithm. The skew motor can then skew the antenna or the LNB as needed to match the calculated value.

The location of the antenna can be provided by user input or by pairing the antenna with a smartphone or other computing device that is GPS capable. A GPS decoder can also be provided within the antenna itself. In other embodiments, the antenna need not receive any location input. The antenna can determine an estimated location itself using the pattern matching steps disclosed herein.

The satellite broadcast reception antenna, converter, motors and control electronics may be fully contained within an enclosure, or they may be partially enclosed, or no enclosure may be provided.

The antenna device, systems and methods according to certain embodiments are not made obsolete by satellite broadcaster protocol changes, such as a change from Quadrature Phase Shift Keying (QPSK) to Eight Phase Shift Keying (8PSK), since the antenna is not tuning in the broadcast stream, but is only looking for patterns of radio frequency (RF) energy.

The satellite broadcast receiving antenna device in one example embodiment of the present invention can be configured as a motorized portable device that can be carried by the user in one hand and which enables easy satellite television reception while camping, tailgating, ice fishing, visiting summer cabin, etc. The antenna system requires no deployment and can be fully enclosed in a lightweight, small enclosure with, or without, a carrying handle. The antenna device can also be configured to be mounted to a vehicle, building, house, pole, ladder, window or other structure.

The satellite antenna device in another example embodiment of the present invention can be configured as a fixed mount antenna that is secured to a user's house, building, pole or other fixed structure. At least the azimuth adjustment of the antenna is motorized and controlled by electronics of the antenna. Such a system can be quickly and easily set up by an end user without specific knowledge of satellite systems by using the automated pointing feature. Additionally, the cost of the motor and control electronics is more than offset by no longer needing a setup technician. Moreover, antennas according to the present invention can be re-aimed as often as needed without having a technician make a service visit to the user.

In-motion tracking of broadcast satellites can be performed once the target satellite(s) have been acquired by the antenna. Motion data can be provided to the motor control systems by one or more gyroscopes or other motion sensors.

By enabling the satellite broadcast receiving antenna to identify the broadcast satellite locations without the need for decoding the data stream or communicating with an external control box, certain antenna components can be eliminated from an overall reception system. For example, the decoding electronic elements can be eliminated because the definitive satellite identification information need not be communicated by an external component. As a result, antenna product and manufacturing costs are reduced, antenna manufacturing is easier and faster, and the weight of the product may be reduced. Reliability and quality of the antenna are also improved. Moreover, the antenna can be universally used with any service provider, external decoder box, and data broadcast scheme. The risk of obsolescence of the antenna is reduced. In addition, there is no need to provide a separate costly and easily lost remote control for independently controlling operation of the antenna system.

Other embodiments, features and functions will be apparent from the detailed description below, from the appended figures and from the claims.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1A:
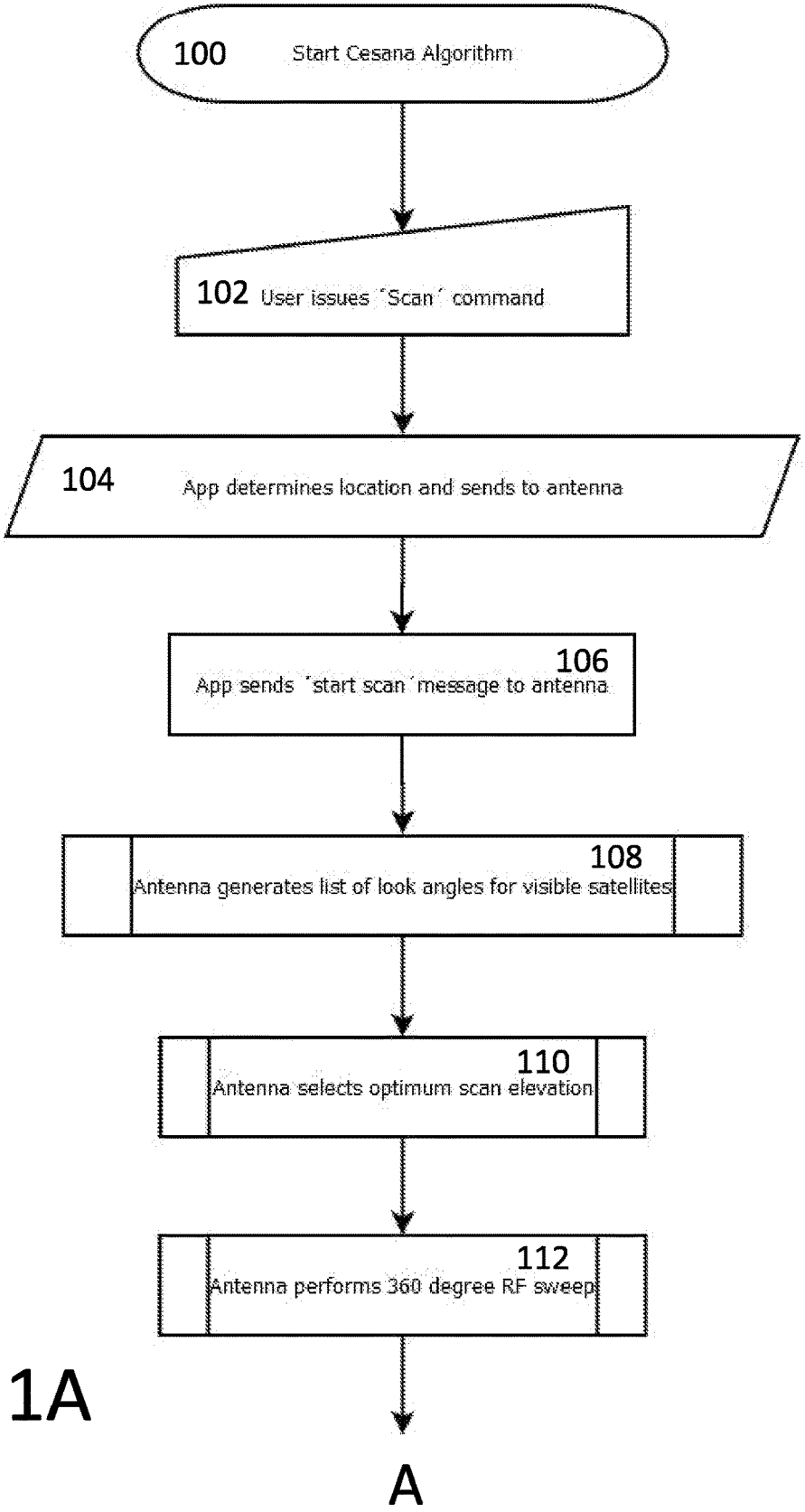
FIGS. 1A and 1B are an algorithm for determining the identity of broadcast satellites according to certain example embodiments.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the scope of the invention as defined by the appended claims.

DETAILED DESCRIPTION

In the following descriptions, the present invention will be explained with reference to various example embodiments; nevertheless, these embodiments are not intended to limit the present invention to any specific example, environment, application, or particular implementation described herein. Therefore, descriptions of these example embodiments are only provided for purpose of illustration rather than to limit the present invention. The various features or aspects discussed herein can also be combined in additional combinations and embodiments, whether or not explicitly discussed herein, without departing from the scope of the invention.

The satellite antenna device and system can take many forms as discussed previously and can be configured for standing on the ground or a surface, or mounted to a structure. The satellite antenna can be fully enclosed, partially enclosed or non-enclosed. The satellite antenna can be configured to aim at one satellite orbital slot at a time or it can be configured to aim at multiple slots simultaneously.

One example antenna apparatus can be configured as a hand transportable antenna system (with or without handle) such as that disclosed in U.S. Pat. No. 7,595,764, the entirety of which is hereby incorporated by reference herein. Also, the antenna apparatus can be adapted to a vehicular mobilized satellite antenna product for mounting on the roof of a vehicle such as disclosed in U.S. Pat. Nos. 6,864,846, 6,937,199 or 8,368,611, each of which are hereby incorporated by reference herein in their entirety as these references show additional satellite antenna device examples that can be adapted to certain embodiments of the current invention.

The operations, structural devices, acts, systems, modules, logic and method steps discussed herein below, according to certain embodiments of the present invention, may take the form of a computer program or software code stored on a tangible or non-transitory machine-readable medium (or memory) in communication with a processor which executes the code or program to perform the described behavior, function, features and methods. It will be recognized by one skilled in the art that these operations, structural devices, acts, logic, method steps and modules may be implemented in software, in firmware, in special purpose digital logic, or any combination thereof, without deviating from the spirit and scope of the present invention as recited within the claims attached hereto.

The positions of the broadcast satellites typically do not change in the sky. Therefore, it is known where the satellite slots are located relative to one another. Such data can be stored in memory as a "visible satellites" pattern data set or table and used as part of an algorithm to determine which particular satellite orbital slot the antenna is pointing to at any given time. The visible satellites pattern data set can also be updated from time to time in order to account for any new satellite positions, to adjust for moved satellite positions and to account for any other changes to the visible satellites. The update procedure can be performed via a smartphone link as discussed later herein, or it could be performed directly by uploading an updated visible satellites data set to the antenna's memory.

The general satellite orbital slot location and identification method, algorithm or logic can include some or all of the following steps:

1. Acquire location estimate for the antenna.

The location estimate need not be provided, and it need not be exact. However, a location estimate in certain embodiments can is preferably within a 50 mile radius of actual location on the earth's surface. The location estimate can be obtained from a variety of means, including from one or more of space-based satellite navigation systems (global position system (GPS), Global Navigation Satellite System (GLONASS), etc.), cell towers, wireless access points (e.g., Wi-Fi hotspots), set top box, and user input, or from any other source. For example the ZIP code where the antenna unit is physically located provides sufficient resolution for the present methodology. A data table of zip codes and corresponding location data or coordinates can be stored in the antenna's memory. The location data provided to or determined by the antenna unit will be referred to herein generally as reference coordinate data.

If no location estimate is provided, then the antenna can calculate its own location estimate using the pattern matching steps described below.

The antenna can also begin the acquisition process using the last elevation, for example, without any user input.

In certain embodiments, the user can input the location estimate (e.g., city, zip code or other reference coordinate data) with a keypad, switches or other input means provided to the antenna unit, or the input can be provided via wireless user interface, or input can be provided via the control box or STB.

In one example, a GPS, GLONASS or other space-based satellite navigation system decoder can be included in the electronics of the antenna. In another example, the antenna includes a low-power Bluetooth interface that allows the antenna to exchange data with a nearby paired smartphone of the user, control box set top box, television, etc. Smartphones typically contain GPS decoders, and the GPS coordinates can be obtained from the user's paired smartphone. Many vehicles also have GPS decoding capability as part of their onboard navigations systems. The antenna unit can also be paired with the vehicle's onboard navigation systems to obtain the GPS data.

2. Capture a set of satellite look angles in the antenna's reference frame coordinate space.

The look angles for potential satellites can be determined by sweeping the antenna though an azimuth range at a given elevation to find local power maxima in the frequency spectrum window of satellite downlink signals (i.e., broadcast signals). The power maxima can then be filtered by performing a statistical match to satellite radiation patterns, thus precluding non-satellite radio frequency sources. The number of look angles required to unambiguously determine a rotation transform from the antenna reference frame to the world reference frame will depend on the specific pattern matching algorithm employed. Sensor and antenna positioning inaccuracies are tolerable through the use of statistical filters (e.g. histogram filtering, kalman filtering, particle filtering, etc.), tuned to the sensors and actuators used and linked to the pattern matching algorithm.

3. Generate pattern of expected look angles from location estimate.

The expected look angle pattern preferably corresponds to satellites with downlink signals in the part of the radio frequency (RF) spectrum in which local power maxima was sensed in the above step (2).

4. Execute pattern matching algorithm to determine azimuth axis rotation to transform antenna reference frame into world reference frame.

This step determines the azimuth angle offset of the antenna's reference frame from the orientation of the real world reference frame. For high density signals, i.e., conditions of multiple visible satellites and narrow antenna beamwidth, image registration techniques are preferably used. For low density signals, Bayesian inference algorithms are preferably used.

5. If the pattern matching algorithm does not provide confidence metrics, or confidence metrics are inconclusive, the look angles of a satellite position outside the set used for pattern matching can be used to validate the correctness of the reference frame transform.

This step provides an alternative means to check (or a means to double-check) the results of the preceding step (4). Using the offset determined in the preceding step (4), a candidate satellite location that was not used in the pattern matching algorithm can be calculated. Then the antenna is aimed at the expected location of the calculated candidate satellite to see if the satellite is where it was expected to be. If the expected satellite is present, then this step confirms the validity of the calculated offset in the preceding step (4). Similarly, a negative result indicates that the calculated offset is likely to be invalid. However, there can be other reasons that the candidate satellite would not be located, such as the line of sight being blocked, so the negative result need not always be determinative of an invalid offset.

Figure 1B:
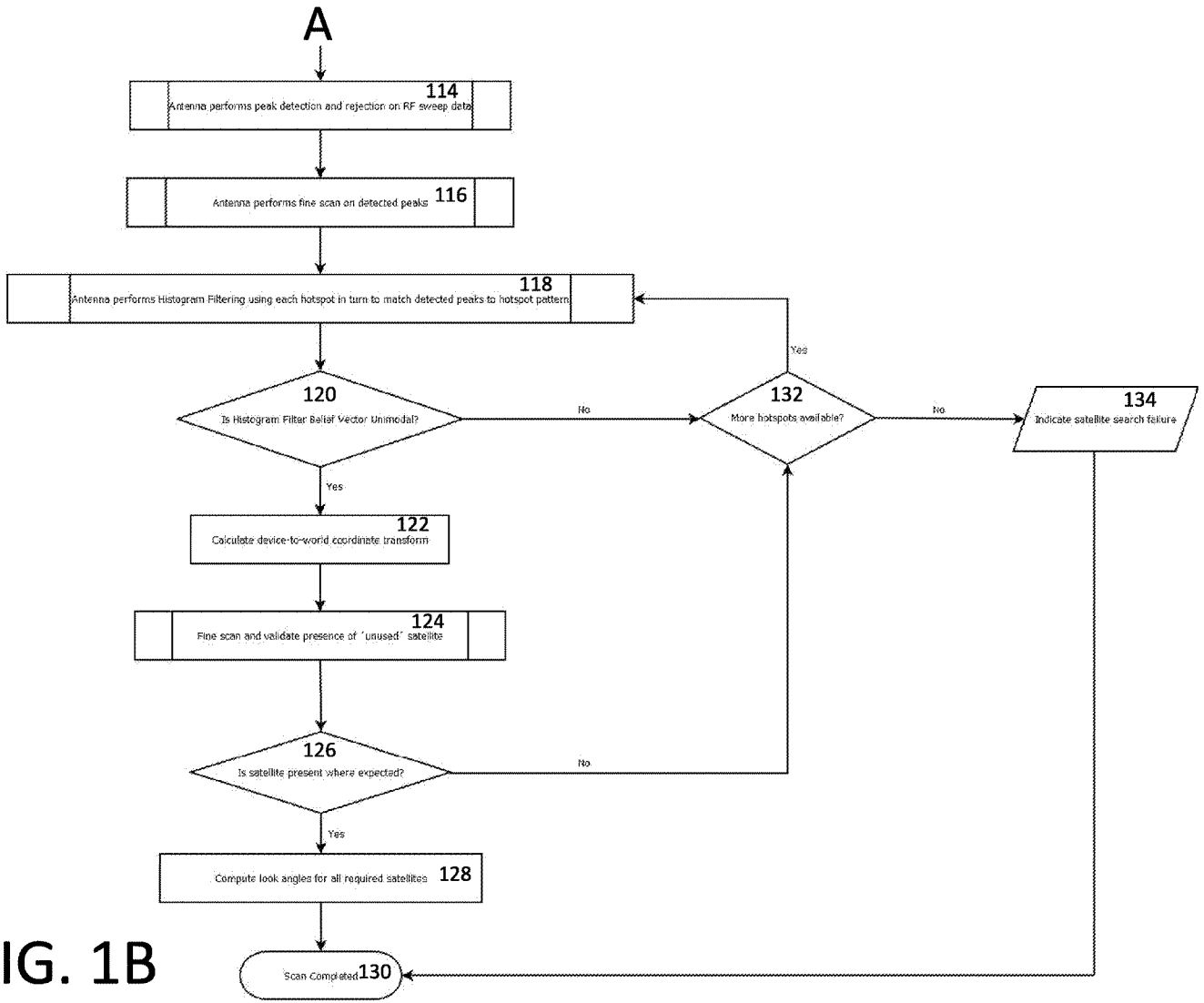

Referring now to FIGS. 1A-1B, the method steps according to one example will now be discussed in greater detail. The user starts their smartphone application for locating satellites 100 and issues a 'Scan for Satellites' command 102. The smartphone application then determines location using GPS or cellular or other method and conveys the location data to the antenna system 104. The smartphone software application issues a command to the antenna to start scanning (or the antenna begins a scan automatically upon receiving the location data) 106. Alternative methods for providing the rough location value can be used, such as the user inputting the location ZIP code, location city, etc.

Next, the antenna generates a list of look angles for satellites visible to the antenna's RF sensor (given transmission strength, antenna gain, LNB reception spectrum and power sensor characteristics) 108. The antenna then picks the highest elevation where one or more satellite peaks will be visible to its RF sensor 110. This is a heuristic algorithm and can be implemented multiple ways, including the use of a clustering algorithm.

The antenna now performs a 360° (or other angular sweep) RF scan and uses a peak detection algorithm to locate signal maxima 112. The azimuth coordinates for each maxima (i.e. peak) are stored in the antenna unit's memory. This is another heuristic algorithm. The antenna unit's logic is configured to reject peaks that do not exhibit a Gaussian signal distribution over azimuth axis 114. For example, the antenna can calculate a median of distribution of the whole sweep and calculate the relative difference between a peak candidate and the calculated average.

Next, the antenna unit performs a further scan or fine scan on each of the peaks to get best estimate azimuth and elevation values for satellites detected at scan elevation 116. Peaks that do not display Gaussian distribution in the dimensions of azimuth and elevation 118 are rejected.

The antenna unit executes a histogram filtering algorithm, starting with the east-most signal peak, matching it to the "visible satellites" pattern stored in the antenna unit's memory. When the histogram filter belief vector becomes unimodal 120, the antenna unit calculates an azimuth rotation required to transform the antenna's reference frame into a world reference frame 122.

Now the antenna unit performs a validation scan 124 at a satellite orbital slot that has not yet been utilized in the histogram filter, as was discussed previously above, to determine whether the validation candidate satellite orbital slot is where it would be expected 126. If validation succeeds, the antenna unit computes look angles of all satellite orbital slots of interest in the antenna unit's reference frame using the computed world reference frame look angles. The scan is then completed 130 and the user is ready to watch television.

If validation step fails, the antenna unit resets its histogram filter and starts again at step 120 using the next signal peak 132. This reset and validation iteration repeats until validation succeeds or no more hotspots are available to analyze. Once no more hotspots are available and a validation has not been successful, then a search failure is reported to the user 134.

Upon a search failure, the user can be prompted via the user interface (e.g. smartphone application) or via a status light (e.g. a red light) provided to the antenna unit to move the antenna to a different location and restart the scan.

Upon a successful validation, a success message can be relayed to the user, e.g. via the smartphone application or a status light illuminated to indicate a successful result (e.g., a green light illuminated).

If the antenna portion of the antenna unit will need to change its aim to jump between multiple orbital slots to see each of the necessary satellites, then the elevation and azimuth coordinates for each satellite orbital position (e.g. corresponding to the user's subscribed programming package) can be stored in the antenna's memory so that the antenna can quickly reposition or re-aim, switch or jump between aim orientations corresponding to each relevant satellite orbital slot without the need for any re-scanning.

The antenna unit can be informed of the user's desired satellites, programming package and/or service provider via switches on the antenna or via the user interface in a setup screen.

In a switching or jumping scenario, the user would be watching television on a first channel. That first channel corresponds to a signal being broadcast from a first particular satellite orbital slot (first slot or position) where the satellite broadcasting that channel is located. If the user changes to a second channel that happens to be broadcast from a satellite located at a different orbital slot (second position or slot), then the antenna system must re-orient its dish or antenna element to receive broadcast data from that second slot.

The need to perform a jump from one orbital slot to another can be indicated to the antenna unit by a message from the service provider's equipment (e.g. from the STB in the form of a tone, DiSEqC message, or similar, over a coaxial cable). In response, the antenna unit's control system energizes one or more motors to move the dish element (e.g. reflector and LNB) to the orientation corresponding to the target satellite position, which was already stored in the antenna unit's memory.

Figure 2:
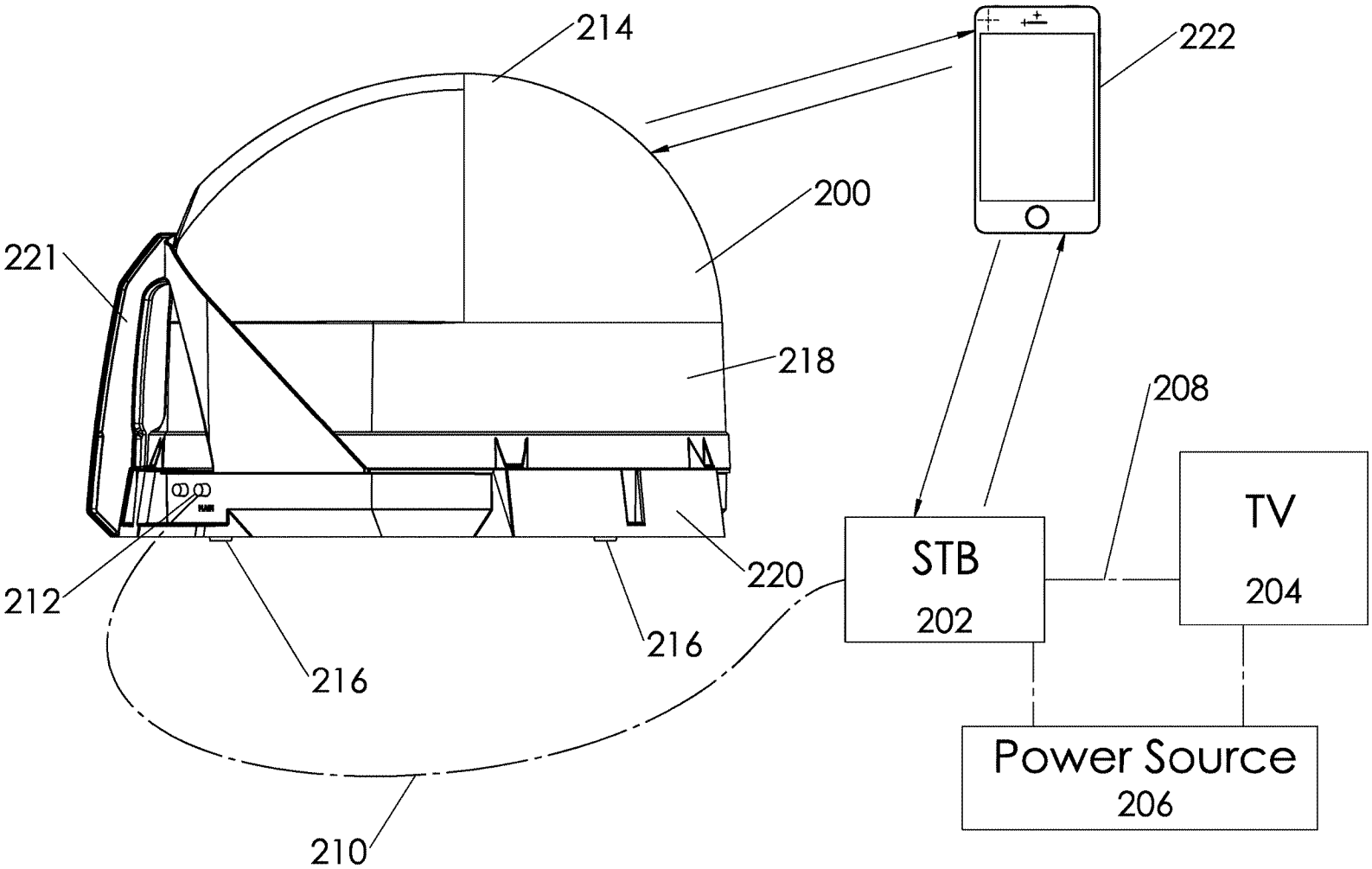
FIG. 2 is a satellite television reception and viewing system diagram according to an example embodiment.

Referring to FIG. 2, a satellite television reception and viewing system according to one example embodiment includes an antenna unit 200, a set top box (STB) 202, a television 204 and a power source 206. The television 204 and STB 202 are both electrically connected to the power source 206. Also, the STB 202 is connected to the television 204 via a communication conduit or cable 208. This cable 208 can be a coaxial cable, an HDMI cable, component cables or other suitable connection means known to those of skill in the art, including various wireless communication methods. Note that the STB 202 functions can be integrated into the television 204

A coaxial cable 210, or other suitable conduit, electrically and communicatively connects the antenna unit 200 with the STB 202. An external fitting 212 can be provided on an exterior surface of the antenna unit's enclosure 214 to allow signal and power to pass through the enclosure while maintaining the sealed feature of the enclosed antenna unit. All signal and power requirements can be routed through a single conduit, or separate signal and power conduits can be provided.

Alternatively, the STB 202 can communicate wirelessly with the antenna 200 via Bluetooth, Wi-Fi or other wireless methods. In such configuration, the antenna would be provided with its own independent power input or power supply. The power supply can be a battery, solar or other source, either internal or external to the enclosure.

A plurality of feet 216 can be provided to the bottom of the enclosure 214 to facilitate the antenna unit 200 sitting on a surface such as the ground or a table, or to facilitate attachment to a bracket.

Some portions or all of antenna 200 enclosure may comprise an electromagnetic wave permeable material that permits the inbound satellite broadcast energy to pass through the enclosure 214 with minimal loss. The enclosure may be sectioned into a top or cover portion 218 and a bottom or base portion 220 to facilitate access to the antenna components enclosed completely within the enclosure 214. The enclosure 214 protects the antenna control system, motors and other components from moisture, dirt, sand, other debris and from impacts that might damage the enclosed components.

A handle 221 or other carrying means can be provided to, or defined in, the enclosure 214 to facilitate carrying of the antenna unit 200 by a single hand of a user.

A user's smartphone 222 containing the software application discussed previously herein is further illustrated in FIG. 2. The smartphone 222 can also take the form of a tablet computer or other computing device such as a personal computer or laptop, or a vehicle's built-in navigation/entertainment system. The smartphone 222 can be paired with the antenna 200 via Bluetooth or other wireless communication methods to conduct two-way data and command exchanges between the respective devices.

The smartphone 222 can also be paired with a Bluetooth enabled STB 202 to conduct two-way data and command exchanges with the STB. Other wireless communication methods can also be employed. For example, the smartphone 222 can obtain the set of desired satellite locations from the STB 202, can obtain television programming guides from the STB 202 (or from the antenna 200), and any other data, such as for example the user's account information. The smartphone can also relay data to the STB 202, including for example location information, and provide the STB 202 with access to the internet for diagnostic data relay and for receiving firmware updates.

The antenna unit's firmware (i.e., software code stored in memory) can also be updated wirelessly (e.g. via the smartphone 222) or via the STB connection using DiSEqC or similar protocols. The software updates to the antenna unit can include an updated database (or updates to the onboard database) of satellites in geostationary orbit so that the antenna's database of visible satellites in orbit is current.

Figure 3:
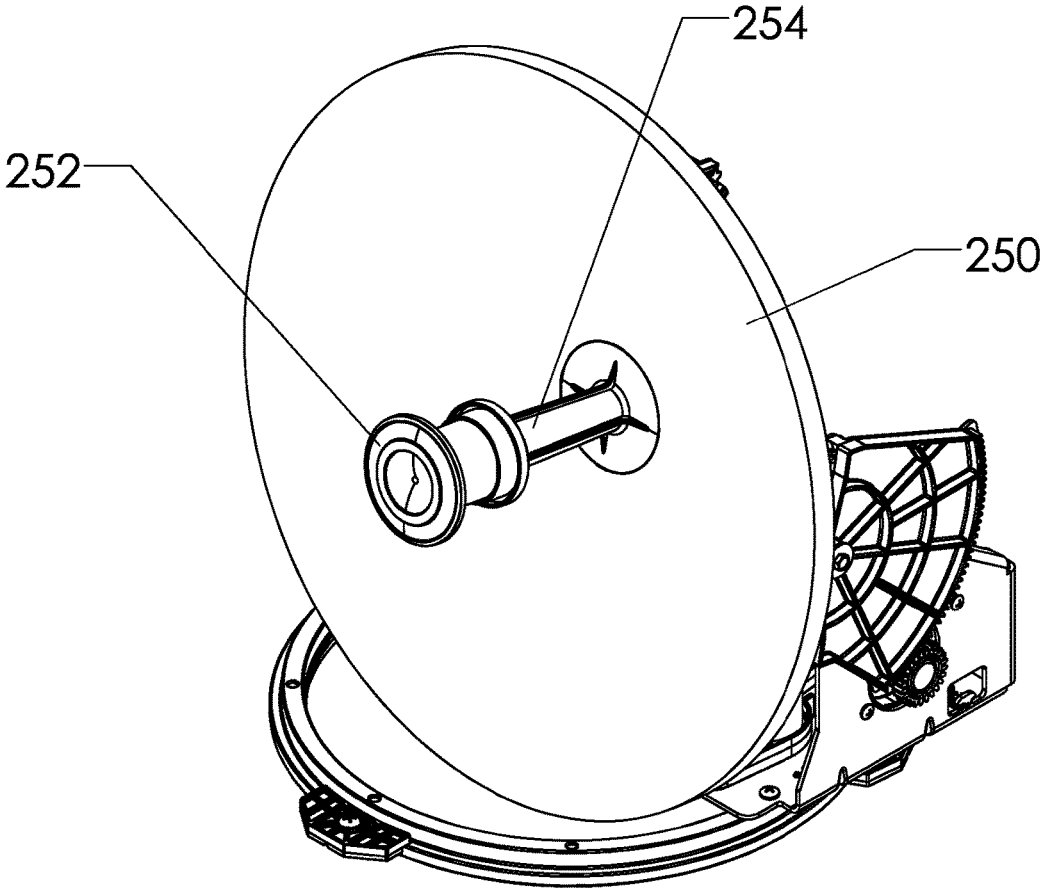
FIG. 3 is a front perspective view of a portion of a satellite antenna unit according to an example embodiment.
Figure 4:
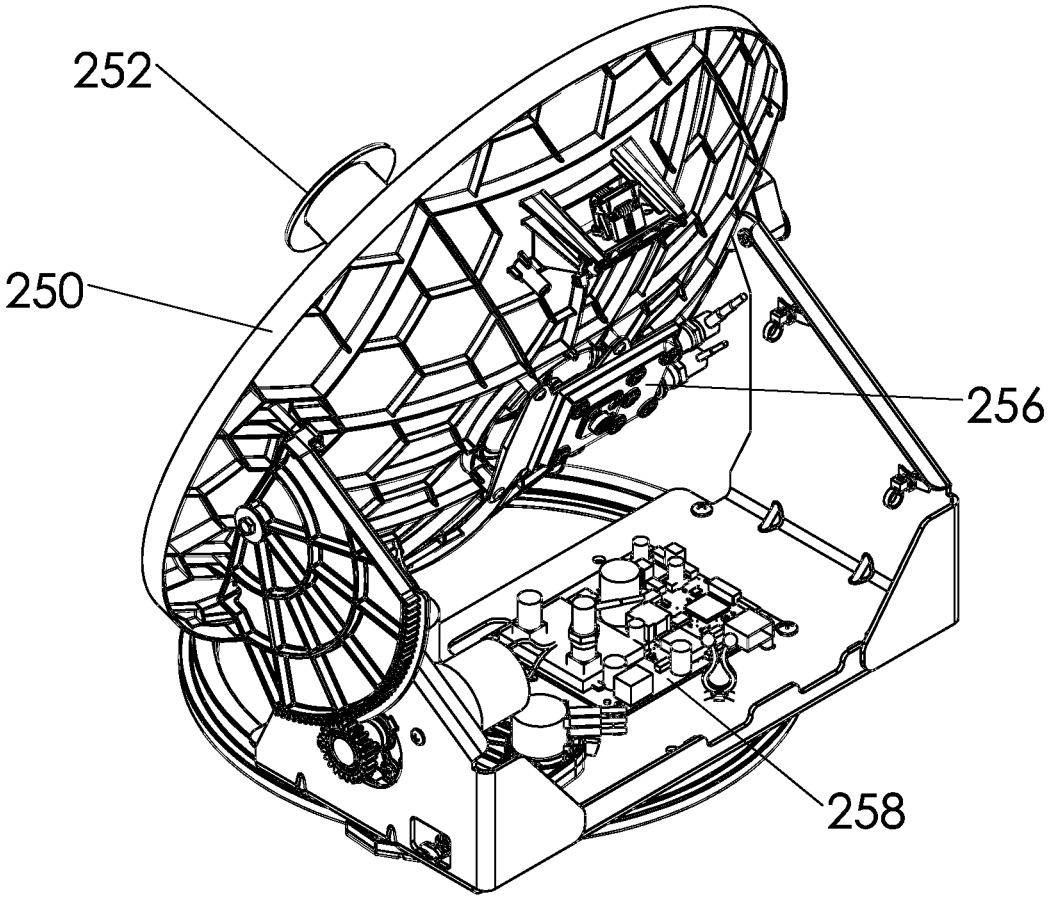
FIG. 4 is a rear perspective view of a portion of a satellite antenna unit according to an example embodiment.
Figure 5:
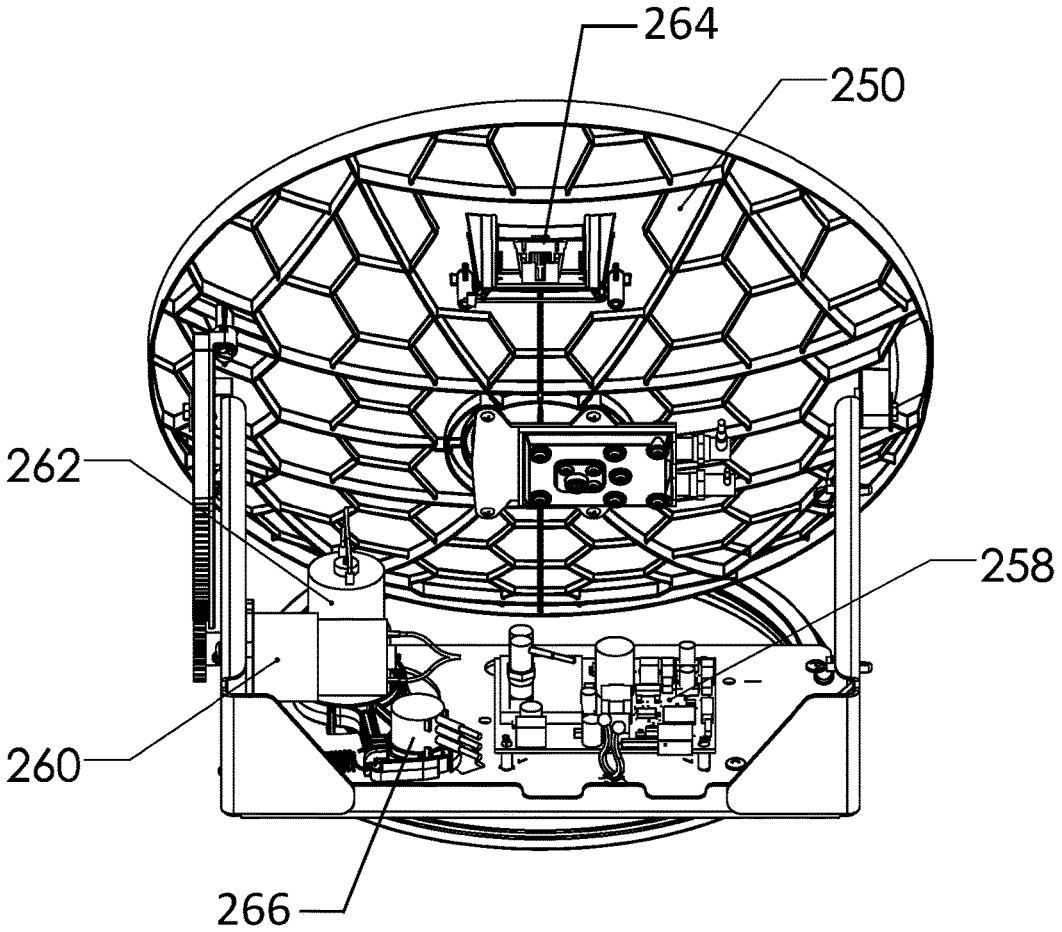
FIG. 5 is a rear perspective view of a portion of a satellite antenna unit according to an example embodiment.

Referring to FIGS. 3-5, certain internal details of the television antenna unit are shown according to one example embodiment. However, the internal components can have other configurations, shapes and sizes without departing from the scope of the invention, for example phased arrays and pseudo phased array configurations. The satellite television antenna unit includes a parabolic reflector dish 250 and a subreflector 252 positioned forward of the dish 250. The dish 250 collects incoming satellite broadcast signals by reflecting them forward to a focal point. The subreflector 252 is located adjacent to the dish's focal point to reflect the collected signal rearward through a waveguide 254 and on to a low noise block (LNB) converter 256 located behind the dish 250. The LNB converter 256 amplifies the collected signals and converts them from microwaves to low frequency signals that are transmitted by the antenna unit to the STB. The STB converts and decodes the television signals provided by the antenna unit so they can appear on the screen of a television.

In one embodiment, orientation or positioning of dish 250 is carried out by a motorized elevation drive system, which includes an elevation motor 260, and a motorized azimuth drive system, which includes an azimuth motor 262, that are each controlled by the antenna control system. The respective motors are coupled to the dish or a support for the dish 250 via gears, gear segments, belts, cables, a combination thereof, or via other suitable means, to selectively orient or aim the dish as controlled by the antenna control system.

The antenna control system includes a microprocessor and physical memory disposed on a control board 258, which is located inside of the enclosure. If the antenna unit is not enclosed, then the antenna control system may be contained within its own enclosure. The memory can be onboard the processor or separate from the processor, or a combination of both. The memory stores the operating software code or firmware for the antenna unit, which is executable by the microprocessor. The microprocessor (also referred to as the processor) then communicates with (or selectively energizes) the motors 260 and 262 to selectively orient or aim the dish 250. The microprocessor also controls communication of the antenna unit with the STB.

The control board also can include motor controllers and/or RF energy detectors.

A GPS receiver can also be provided to the control board 258, or other portion of the antenna unit inside of the enclosure according to certain embodiments. The GPS receiver in such embodiments communicates with the processor to provide data that the processor uses to calculate look angle data for geostationary satellites visible from the geographic location of the antenna unit.

An automatic leveler 264 can further be provided to the antenna unit. The automatic leveler 264 allows the antenna unit to compensate for an unlevel condition. For example, slight adjustments to the elevation of the antenna element can be made while the element rotates in the azimuth direction so that a true azimuth rotation can be achieved despite the rotational platform on which the antenna element is mounted being in a non-level condition. This feature can reduce or completely eliminate the need for the user to level the antenna unit prior to use.

An azimuth position sensing device 266 can further be provided to the antenna unit. This sensing device in certain embodiments can be a potentiometer. The azimuth position sensing device provides a reference for the relative position of the antenna element (e.g., the dish 250 and LNB 256) with respect to the antenna units base.

Figure 6:
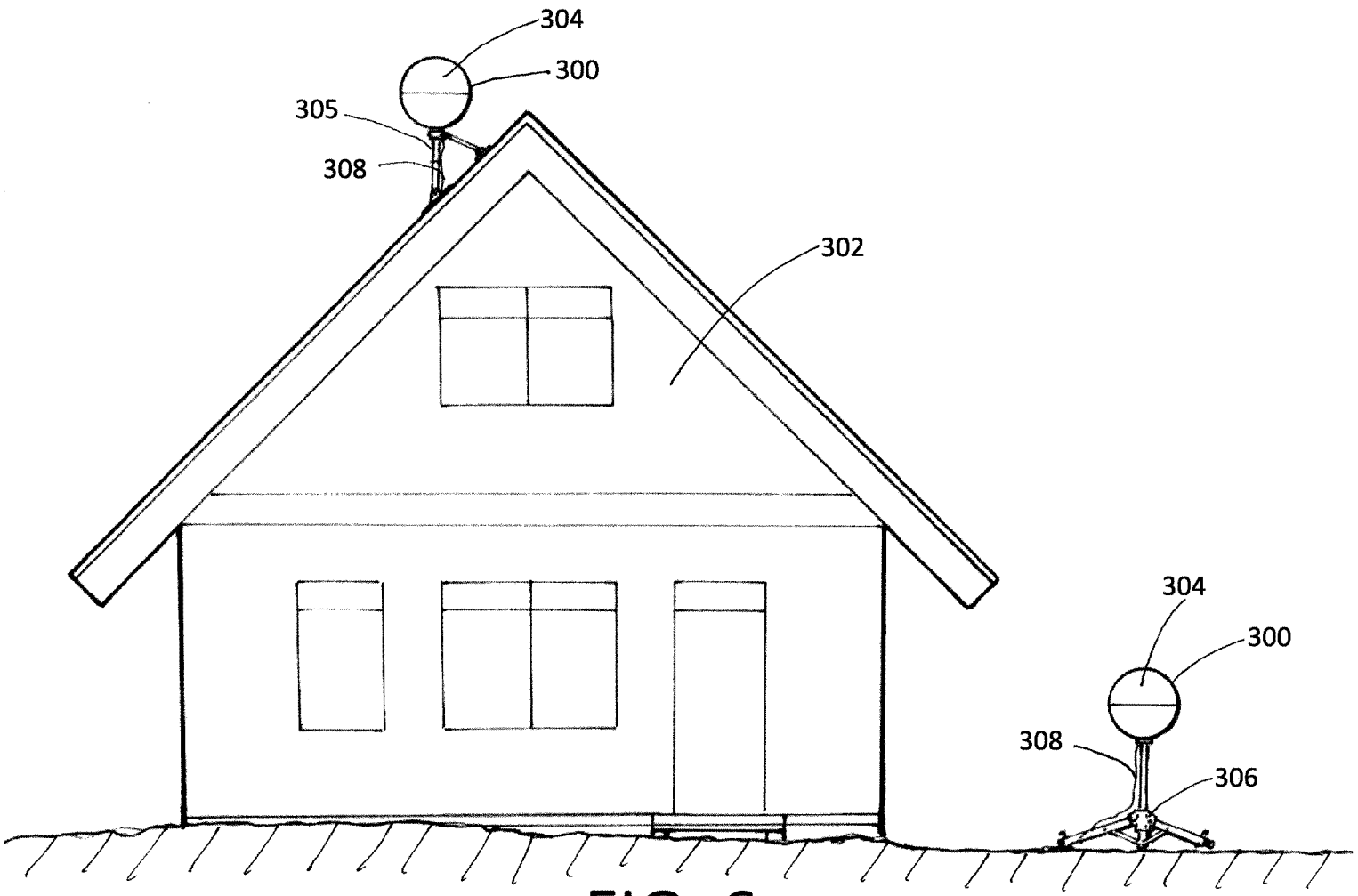
FIG. 6 is an illustration of satellite antennas deployed in a home or building setting according to certain example embodiments.

The systems, units, devices, apparatus and methods described herein can also be provided in the form of a kit that a user could easily self-install for their home or business. The kit includes a satellite reception antenna system 300 and associated mounting hardware. Referring to FIG. 6, the user mounts the antenna system 300 on their home 302 so that the antenna's reflector dish 304 has a clear view of the sky. For example, a roof mounting bracket 305 can be fastened to the roof of a house 302 and the antenna 300 subsequently secured to the bracket 305. Alternatively, the antenna device can be mounted on a pole, tripod 306 or other support.

Next, the user connects the cabling 308 to both the antenna device 300 and to the STB (typically located inside of the home nearby the television) or other satellite signal decoder. Then the user initiates an auto install command for the antenna system 300 via one of a paired smartphone, via the set top box, via a switch on the antenna, or via other means. If necessary, the user will be prompted to input a location estimate such as their zip code. The antenna control system then actuates the unit's motors to move the reflector dish in one or more of elevation, azimuth and skew, to perform a satellite location and identification routine, thereby aiming the reflector dish at the desired satellite orbital slots. The user is thus able to watch their television without the need for a professional installation.

Instead of using cabling 308, the antenna 300 can be connected to the set top box/decoder wirelessly using any suitable wireless communication protocol, such as Wi-Fi. The antenna electronics can also be powered by means such as solar cells and/or batteries.

While the invention has been described in connection with what is presently considered to be the most practical and preferred example embodiments, it will be apparent to those of ordinary skill in the art that the invention is not to be limited to the disclosed example embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A method of aiming a satellite broadcast reception antenna at a target orbital slot, the satellite broadcast reception antenna comprising an onboard antenna control system, a motor coupled to the antenna control system and an antenna element operably coupled to the motor, the method comprising:

acquiring by the antenna control system a location estimate for the satellite broadcast reception antenna;

rotating the antenna element in an azimuth range at a given elevation to identify at least one local power maxima in a frequency spectrum window corresponding to a satellite downlink signal broadcast by a satellite located in the target orbital slot;

generating a list of look angles by the antenna control system based upon the identified at least one local power maxima;

storing the list of look angles in a memory of the antenna control system;

determining by the antenna control system an azimuth angle offset for the antenna element of the satellite broadcast reception antenna as compared to a world reference frame; and validating by the antenna control system the azimuth angle offset based upon a verification orbital slot that was not utilized in the step of determine an azimuth angle offset for the antenna element.

2. The method of claim 1, wherein the location estimate is a set of reference coordinates.

3. The method of claim 1, wherein the location estimate is a zip code.

4. The method of claim 1, further comprising:

wirelessly pairing the satellite broadcast reception antenna with an external computing device; and transmitting from the external computing device to the satellite broadcast reception antenna a location data.

5. The method of claim 1, further comprising actuating the motor to aim the antenna element at the target orbital slot if the azimuth angle is validated.

6. The method of claim 1, wherein the step of determining the azimuth angle offset includes the antenna control system matching the at least one local power maxima to a visible satellites pattern stored in the memory of the antenna control system.

7. A method of locating one or more target satellite orbital slots with a satellite broadcast reception antenna, the method comprising:

generating by a microprocessor of the satellite broadcast reception antenna a list of look angles for satellites potentially visible to a radio frequency (RF) sensor of the satellite broadcast reception antenna;

orienting an antenna element of the satellite broadcast reception antenna to align with a highest elevation where one or more satellite broadcast energy maxima are determined by the microprocessor to be visible to the RF sensor;

sweeping the antenna element in an azimuth axis to locate signal maxima by the microprocessor;

storing azimuth coordinates for each maxima in a memory coupled to the microprocessor;

matching by the microprocessor the located maxima against a visible satellites pattern stored in the memory;

determining by the microprocessor an azimuth offset required to transform a reference frame of the satellite broadcast reception antenna into a world reference frame.

8. The method of claim 7, further comprising validating the azimuth offset by the microprocessor by comparing a verification orbital slot not used in the azimuth offset determination that is expected to be present from the visible satellites pattern stored in the memory against the azimuth coordinates for each maxima stored in memory to verify a match.

9. The method of claim 7, further comprising:

computing a look angle corresponding to each of the one or more target satellite orbital slots based upon the azimuth offset; and energizing a motor of the satellite broadcast reception antenna by the microprocessor to aim the antenna element in the azimuth axis at a first one of the one or more target satellite orbital slots.

10. The method of claim 9, further comprising energizing the motor of the satellite broadcast reception antenna by the microprocessor to aim the antenna element in the azimuth axis at second one of the one or more target satellite orbital slots in response to a user changing television channels on a television set top box, wherein the aiming at the second one of the one or more target satellite orbital slots is performed without a scan for RF energy by the satellite broadcast reception antenna.

11. The method of claim 7, further comprising validating the azimuth offset by the microprocessor based upon the visible satellites pattern stored in the memory.

12. The method of claim 11, further comprising providing a first visible indication to a user when the validation step is successful and a second visible indication to the user when the validation step is unsuccessful, wherein the first and second visible indications are different.

13. The method of claim 7, further comprising acquiring by the antenna control system a location estimate for the satellite broadcast reception antenna.

14. The method of claim 7, further comprising the microprocessor generating the list of look angles based upon a location for the satellite broadcast reception antenna being the same as determined in a previous scan operation.

15. The method of claim 7, further comprising eliminating located maxima from further evaluation that do not display a Gaussian distribution in an azimuth and an elevation dimensions.

16. A satellite broadcast reception antenna, comprising:

an antenna element;

a motor coupled to the antenna element such that the motor can sweep the antenna element in an azimuth axis; and an antenna control system coupled to the first motor, the antenna control system including a physical memory and a microprocessor, wherein the antenna control system is configured to:

generate a list of satellite broadcast energy maxima collected by an azimuth sweep of the antenna element;

match the list of broadcast energy maxima against a visible satellites pattern stored in the memory; and determine an azimuth offset required to transform a reference frame of the antenna element into a world reference frame.

17. The satellite broadcast reception antenna of claim 16, further comprising a GPS receiver coupled to the microprocessor, the GPS receiver providing the microprocessor with a data for a location of the satellite broadcast reception antenna.

18. The satellite broadcast reception antenna of claim 16, wherein the antenna control system is further configured to validate the azimuth offset by matching a satellite maxima located by the antenna element against an expected satellite maxima when utilizing the determined azimuth offset.

19. The satellite broadcast reception antenna of claim 16, wherein the antenna control system is further configured to jump the antenna element from a first azimuth orientation to a second azimuth orientation in response to a user changing channels via a television set top box.

20. The satellite broadcast reception antenna of claim 16, wherein the an antenna element, the motor and the antenna control system are each disposed entirely within an enclosure, wherein at least a portion of the enclosure comprises an electromagnetic wave permeable material.

* * * * *